United States Patent [19]

Arsenault

[11] 4,005,291

[45] Jan. 25, 1977

[54] IONIZATION METHOD FOR MASS SPECTROMETRY

[75] Inventor: Guy P. Arsenault, Lexington, Mass.

[73] Assignee: Massachusetts Institute of Technology, Cambridge, Mass.

[22] Filed: Sept. 27, 1973

[21] Appl. No.: 401,284

Related U.S. Application Data

[63] Continuation-in-part of Ser. No. 215,373, Jan. 4, 1972.

[52] U.S. Cl. ..... 250/282; 250/424

[51] Int. Cl.[2] ..... H01J 39/34

[58] Field of Search ..... 250/281, 282, 423, 424, 250/427

[56] References Cited

UNITED STATES PATENTS

| | | | |
|---|---|---|---|
| 3,405,263 | 10/1968 | Wanless et al. | 250/285 |
| 3,555,272 | 1/1971 | Munson et al. | 250/424 |
| 3,582,645 | 6/1971 | Brunnee et al. | 250/423 |
| 3,621,240 | 11/1971 | Cohen et al. | 250/282 |

*Primary Examiner*—Alfred E. Smith
*Assistant Examiner*—B. C. Anderson
*Attorney, Agent, or Firm*—Arthur A. Smith, Jr.; Martin M. Santa; Paul J. Cook

[57] ABSTRACT

A gas, vapor or aerosol substance is ionized for mass spectral analysis by passing the substance through a chemical ionization zone in the presence of (a) charge exchange reactant gas or hydrogen and (b) a chemical ionization reactants' gas. The ionized substance can be passed directly to a mass spectrometer or through an electron impact ionization zone and then to the mass spectrometer.

23 Claims, 3 Drawing Figures

IONIZATION METHOD FOR MASS SPECTROMETRY

The invention herein described was made in the course of work performed under a contract with the Department of Health, Education, and Welfare.

REFERENCE TO RELATED APPLICATIONS

This application is a continuation-in-part of application Ser. No. 215,373, filed Jan. 4, 1972, which is incorporated herein by reference.

BACKGROUND OF THE INVENTION

This invention relates to a process for ionizing substances including aerosols, vapors and gases and analyzing the ionized substances by mass spectrometry.

Within the past few years there has been added to the electron impact ionization (E.I.) mode of ionizing substances in the gaseous state for mass spectrometric analysis a mode of ionizing substances known as chemical ionization (C.I.). In electron impact ionization the substance under investigation is bombarded with electrons, whereas in chemical ionization the substance is reacted with a known preselected set of reactant ions. In practice, chemical ionization is achieved by forming primary ions by electron impact ionization of a reactant gas at pressures greatly in excess of those used in electron impact ionization of substances (e.g. about 1 Torr for C.I. vs. about $10^{-4}$ Torr or less for E.I.). The primary ions thereby formed undergo ion-molecule reactions with electrically neutral reactant gas molecules so as to produce reactant ions. Finally, chemical ionization of the substance under investigation occurs in the same reaction zone by ion-molecule reactions of the substance with the reactant ions. Of course, all of these three steps occur substantially simultaneously and continually in the C.I. zone. In general, chemical ionization mass spectra have fewer ions and more intense high mass ions as compared to electron impact mass spectra and the two ionization techniques are highly desirable complementary analytical tools. A comparison and further analysis of these techniques may be found in applicant's article, "Chemical Ionization Mass Spectrometry," appearing as chapter 31 of "Biochemical Application of Mass Spectrometry," edited by G. R. Waller, Wiley-Interscience Publisher's, New York, New York, 1972.

Because of the complementary nature of the two ionization techniques, attempts have been made to provide a single ion source capable of both chemical and electron impact ionization at consecutive times, with the reactant gas pressure being the determinant of whether the sources operated in a C.I. or an E.I. mode. However, because the C. I. pressures are considerably above the typical pressure in the analyzer region of the mass spectrometer (usually less than $10^{-5}$ Torr), a gas tight region in communication with an ion source must be provided. This requires that the electron entrance and ion exit apertures be very small which in turn reduces significantly (by roughly an order of magnitude) the sensitivity of the source in the electron impact mode of operation, simply due to the decrease in the number of electrons entering the source through the narrow electron entrance aperture and the decrease of the number of ions leaving the source through the narrow ion exit aperture.

Moreover, when the ion source is fed from the outlet of a gas chromatographic column, an analytical technique gaining much importance wherein, the mass spectrometer becomes the detector for gas chromatography, additional problems for the combined C.I. - E.I. source are encountered. For chemical ionization, the technique is simple since the effluent from the gas chromatographic column may be fed directly to the ion source of the mass spectrometer, with the carrier gas of the effluent serving as the reactant gas in the ion source. However, if the effluent is to be subjected instead to electron-impact ionization, a splitter or a separator must be provided at the gas chromatography-mass spectrometer interface, thereby complicating an otherwise simple interface. Alternatively, the effluent flow rate is reduced drastically to maintain the pressure in the ion source at the level required for electron impact ionization. Such flow rate changes make difficult correlation between the C. I. and E. I. spectra of the effluent. Moreover, because of the large disparity in pressure required for the E. I. and C. I. modes, switch over in the middle of a gas chromatographic peak (typically of 15 seconds duration at ½ height) is not possible. Thus, distinct time-separated runs are needed on duplicate sample injections and hence, despite all efforts at identity and ignoring the considerable time loss in such duplicate injections, a great deal of effort is required to correlate the E. I. and C. I. spectra.

The invention described in the above-identified application provides a process and apparatus which eliminates the problems described above and provides a means for successfully subjecting a gaseous substance contemporaneously to electron impact and chemical ionization. The apparatus comprises two separate ionization zones wherein a gaseous substance first is subjected to chemical ionization at chemical ionization pressures and subsequently subjected to electron impact ionization at electron impact ionization pressures. Suitable pressures in each ionization zone are maintained by an aperture of appropriate size between the two ionization zones. Both electrically neutral and ionized gases are passed sequentially through the two ionization zones and subsequently to a mass spectrometer. The apparatus disclosed in the above-identified application can be used in the process of this invention which is described below.

In prior art processes involving chemical ionization, the reactant gas is chosen so that it permits a substantial portion of the substance being analyzed to become ionized but does not cause the substance to disassociate by virtue of a large energy transfer from the ionized reactant gas to the substance. However, when analyzing a substance by concomitant E. I. and C. I., the use of a single reactant gas incurs disadvantage which reduces the sensitivity of the total analytical procedure. For example, in present processes involving E. I., the use of high concentrations of methane gas as the reactant gas substantially reduces the sensitivity of the subsequently-employed mass spectrometer. This is because methane has a large ionization cross-section of $4.7 \times 10^{-16}$ cm$^2$ and thus, when employed in high concentrations, is able to capture large portions of the electrons generated in the ion source in preference to the substance. On the other hand, methane as a reactant gas is desirable in C.I. since it has the ability to capture electrons, thereby forming reactant ions which ionize the substance to form relatively stable ionized substances. As a further example, helium has not been used as a reactant gas in C.I. since ionized helium would give rise to high energy transfer to the substance being analyzed. This energy transfer would not give rise to protonated molecules of the substance but would cause the substance to dissociate to give electron impact-like spectra. While this is desirable in E.I., it is undesirable in C.I. since the resultant spectra for both the C.I. and E.I. would be very similar and the advantages obtained by the use of the two complementary analytical techniques would be lost.

SUMMARY OF THE INVENTION

This invention provides a process for analyzing substances by subjecting the substance sequentially and contemporaneously to chemical ionization and electron impact ionization in the presence of (a) a charge exchange reactant gas or hydrogen and (b) a chemical ionization gas and directing the products of both ionization steps to a mass spectrometer. Charge exchange reactant gases are those which react with the chemical ionization gas primarily by electron transfer reaction under conditions of pressure and temperature encountered in the chemical ionization zone. Generally, C.I. is conducted at a pressure between about 0.1 and 2 Torr and at a temperature between about room temperature and 400° C. Chemical ionization reactant gases react with the substance being analyzed primarily by proton or hydride transfer reactions. The relative concentration of the charge exchange reactant gas and the chemical ionization reactant gas in the chemical ionization step is controlled to prevent substantial direct electron impact ionization by electrons as well as substantial charge exchange ionization of the substance being analyzed while facilitating reaction of the ionized charge exchange reactant gas with the chemical ionization reactant gas. The ionized chemical ionization reactant gas produced then reacts with the substance to produce ionized forms of the substance. The ionized products obtained in the chemical ionization step then can be transmitted either directly to a mass spectrometer or to an electron impact ionization zone. When transmitted to an electron impact ionization zone, electrically neutral substrate to be analyzed also is transmitted thereto by virtue of the pressure differential between the two zones and the products obtained from the electron impact ionization zone are transmitted to the mass spectrometer.

The process of this invention can be conducted with the apparatus described in U.S. application Ser. No. 215,373, filed Jan. 4, 1972. As disclosed in that application, the apparatus employed is provided with flow means for directing the electrically neutral gaseous substances in a path sequentially through the chemical ionization zone and the electron ionization zone and means for directing and impelling the gaseous ions formed in the ionization zones in a path towards the mass spectrometer. Pressure differential between the chemical ionization and electron impact ionization zones can be maintained by providing a small aperture for gas flow between the two ionization zones, so that electrically neutral gases are directed sequentially through the chemical ionization zone and the electron impact ionization zone. In addition, a second smaller aperture is provided for the entrance of the electrons and is located so that gas exiting from the C.I. zone is pumped away without passing through the E.I. zone. Also, the gaseous ions formed are impelled by electrical means, namely by applying suitable potential along the desired path to impel the ions to the mass spectrometer. The numerical value of electrical potentials are chosen so as to provide a decreasingly positive potential in the desired ion flow direction. An additional potential is applied to an electrically conductive ion-permeable screen which is located between the two ionization zones. The potential is negative with respect to the potential at the first ionization zone in order to impel positive ions formed in the first ionization zone past it and into the second ionization zone.

DESCRIPTION OF SPECIFIC EMBODIMENTS

Figure 1:
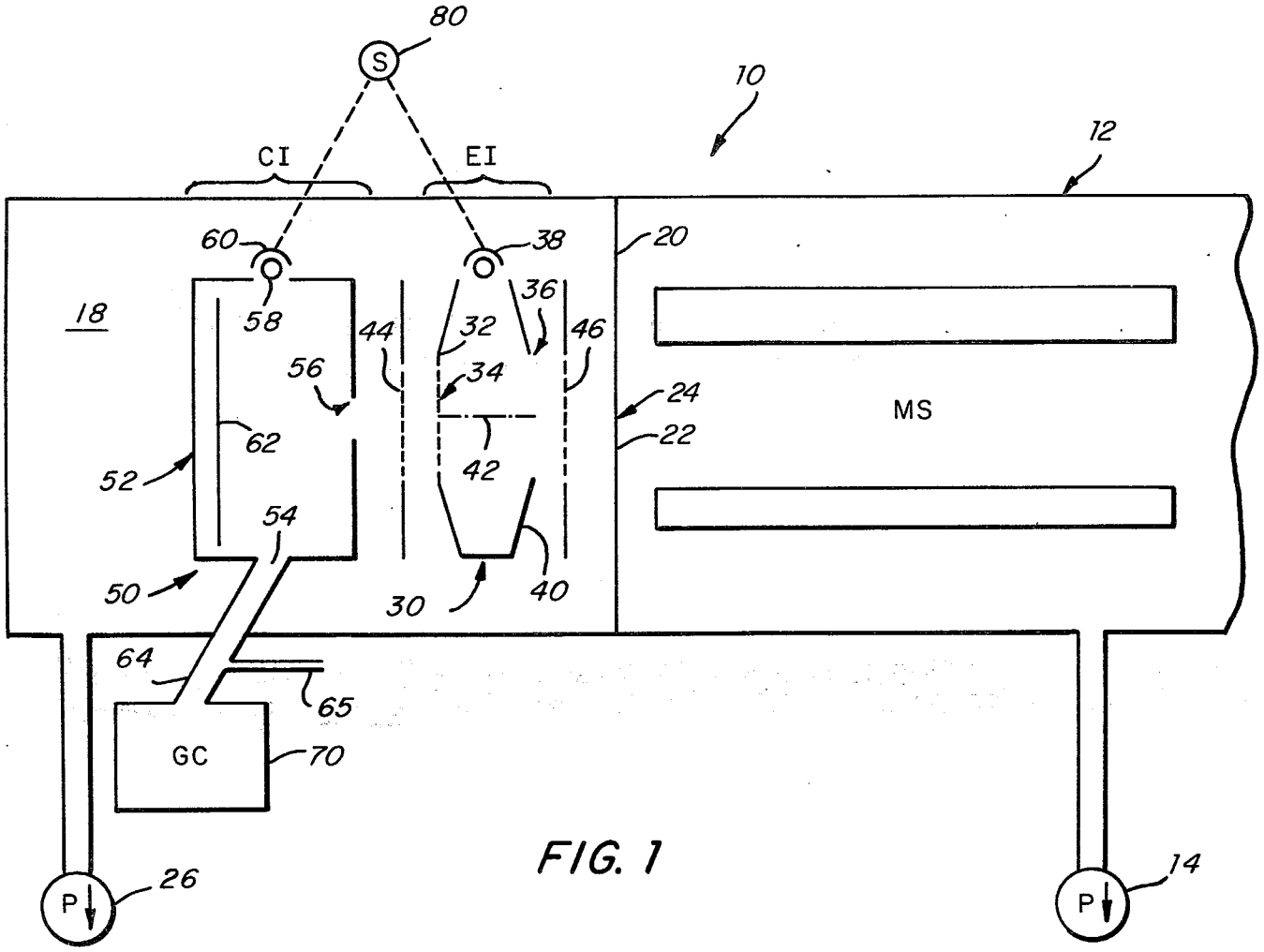
FIG. 1 is a schematic view of an apparatus useful for practicing the process of this invention.

Charge exchange reactant gases suitable for use in the present invention are those which, under chemical ionization conditions, react with the chemical ionization reactant gases primarily through electron transfer reactions. Exemplary charge exchange reactant gases include the inert gases such as helium, argon, etc., nitrogen and oxides, of carbon, sulphur and nitrogen. Although hydrogen normally is considered as a chemical ionization gas as defined herein, it is useful in the process of this invention as a substitute for the charge exchange reactant gas for use in conjunction with the chemical ionization reactant gases. Hydrogen can be used in this manner because the proton affinity of hydrogen, 100 Kilocal/mol is less than the proton affinity of the chemical ionization gases set forth herein. As a result, in a mixture consisting of 80 vol % hydrogen and 20 vol % water vapor, the following sequence of reaction takes place under normal C.I. conditions giving rise only to reactant ions characteristic of water.

$$H_2 + e^- \rightarrow H_2^{+\cdot} + 2e^-$$

$$H_2^{+\cdot} + H_2 \rightarrow H_3^+ + H.$$

$$H_3^+ + H_2O \rightarrow H_3O^+ + H_2$$

It is preferred to employ helium or hydrogen as the charge exchange reactant gas.

Chemical ionization reactant gases which are suitable for use in the present invention are those which, under chemical ionization conditions, yield reactant ions which react with the substrate primarily by proton or hydride transfer reaction. Exemplary suitable chemical ionization gases include water, ammonia, boron hydrides, dimethylamine, methanol, dimethyl ether, isobutane, acetone, tetramethylsilione, hydrogen sulfide and organic gases, vapors or aerosols, such as methane and the like. Water is the preferred chemical ionization gas.

The reaction mechanism under C.I. reaction conditions for the preferred charge exchange reactant gas - chemical ionization reactant gas system is shown by the following equations wherein (I) represents the substance.

$$He + e^- \longrightarrow He^{+\cdot} + 2e^-$$

$$H_2O + e^- \longrightarrow H_2O^{+\cdot} + 2e^-$$

-continued $$H_2O + He^{+\cdot} \longrightarrow H_2O^{+\cdot} + He$$

$$H_2O^{+\cdot} \xrightarrow{H_2O} H_3O^+ \underset{}{\overset{H_2O}{\rightleftharpoons}} H_3O_2^+ \overset{H_2O}{\rightleftharpoons} H_7O_3^+$$

$$(I) + H_3O^+ \longrightarrow (I)\,H^+ + H_2O$$

The relative concentrations of the charge exchange reactant gas and the chemical ionization reactant gas suitable for obtaining both C.I. and E.I. mass spectra will vary depending upon the particular gases employed. However, the minimum concentration of chemical ionization reactant gas for a given mass spectrometer and for a given gas pressure in the C.I. zone can be determined by the following procedure: In the apparatus described herein, a mixture of the substance and the charge exchange reactant gas, e.g., helium, is passed into the C.I. zone under normal C.I. conditions and the resultant products are passed into the mass spectrometer without subjecting these products to E.I. In the absence of a chemical ionization reactant gas, the ionization products will have an E.I.-like mass spectrum. After the mass spectrum is determined, chemical ionization reactant gas, e.g., water, is introduced into the C.I. zone in admixture with the charge exchange reactant gas and the substrate at gradually increasing concentration and the mass spectrum of the resultant ionized products is observed continually. The lowest concentration of the chemical ionization reactant gas at which the ratio of typical C.I. products and typical E.I. products is essentially constant as a function of chemical ionization reactant gas concentration represents the minimum concentration of chemical ionization reactant gas at which accurate C.I. and E.I. mass spectra can be obtained. It is desirable to employ the minimum concentration of chemical ionization reactant gas because this permits optimum E.I. sensitivity and minimizes the pumping requirements for the mass spectrometer.

The use of chemical ionization reactant gas above the minimum concentration permits obtaining both C.I. and E.I. mass spectra concomitantly but is not desirable because of the decrease in sensitivity in the E.I. mode and the increased pumping requirements when hydrogen or helium are employed as the charge exchange reactant gas.

For the preferred reactant gas composition, useful volume ratios of helium to water range from 99 : 1 to 4 : 1.

The apparatus shown in FIG. 1 will be described herein in terms of typical conditions employed during its use.

FIG. 1 shows a portion of a mass spectrometer 10, for illustrative purposes, a QUAD 300 (Electronic Associates, Inc.) Quadrupole Mass Filter mass spectrometer, having a quadrupole mass filter region 12 and a diffusion pumping system 14, which maintains a pressure in the filter region 12 of about, e.g., $3 \times 10^{-5}$ Torr. Filter region 12 is separated from vacuum envelope 18 by a gastight ground plate or lens 20, having a centrally located aperture 22 (diameter 0.150 in.) containing a mechanically transparent and electrically opaque screen 24, of the type conventionally used in mass spectrometers, and which is electrically grounded. Vacuum envelope 18 is evacuated continuously through second diffusion pumping system 26 (e.g, a 180 liters/sec. capacity diffusion pump for a vacuum envelope having a volume of about 250 cc) which maintains the pressure within vacuum envelope 18 at about $4 \times 10^{-4}$ Torr.

Located within vacuum envelope 18 is a cross-axial electron-impact ionization (E.I.) source 30, having a ¼ inch diameter entrance aperture 32 containing an electrically opaque, mechanically transparent screen 34, a 0.150 in. diameter exit aperture 36, and a filament 38. E.I. source 30 is maintained at an electrical potential of +6 volts relative to ground plate 20. This and all other illustrative potentials are relative to ground plate 20 unless otherwise specified. Illustratively, the solid walls 40 of E.I. source 30 are about 0.5 in. high, the spacing between apertures 32 and 36 is about 0.2 in., and the spacing between filament 38 and the center axis 42 between the apertures 32 and 36 is about 0.3 in.

Impeller screens 44 and 46 are stationed on each side of ionizer 30. C.I. impeller screen 44 is located about 0.1 in. from aperture 32 and E.I. impeller screen 46 is located about 1/16 in. from aperture 36 and 1/16 in. from ground lens 20. Each impeller screen 44, 46 is circular having a diameter of about 0.15 inches and is made of 45 × 0.001 in. wires per inch mesh, so as to be electrically opaque and mechanically transparent. The screens 44 and 46 are maintained at a potential of −10 volts relative to ground plate 20 by a suitable power supply (not shown).

Chemical ionization (C.I.) source 50 has a gas-tight enclosure 52 at a potential of +6 volts relative to ground plate 20. The enclosure 52 has a 0.2 in. diameter entrance aperture 54, and a 14 mil. diameter exit aperture 56, the axis of apertures 54 and 56 being perpendicular to one another. A 12 mil. diameter electron aperture 58 is required to expose the C.I. filament 60 — e.g., a 20 mil., wide × 1 mil. thick × ¼ in. long rhenium filament maintained at −250v (supplied by a suitable power source, not shown) with respect to the enclosure 52. The pressure inside enclosure 52 is about ½ Torr, the apertures 56 and 58, and the second pumping system 26 being selected to maintain a pressure of $4 \times 10^{-4}$ Torr in the envelope 18 despite the several orders of magnitude greater pressure in enclosure 52. The aperture 58, in lieu of being located as shown, might also be perpendicular to the other apertures (i.e., in the "top" of the C.I. source as shown in FIG. 1). In general, it is preferred, for adequate sample residence time in the C.I. source, that no two of the apertures be arranged in "line of sight" of one another. The aperture 58 is required only because of filament 60, and gases exiting this aperture will, in general, be pumped out by pumping system 26 and will not proceed to the E.I. source.

A circular repeller plate 62 (about 0.375 in. in diameter) is located within enclosure 52 and is maintained at a potential of +10 volts with respect to the potential applied to enclosure 52 by a suitable power supply (not shown).

Component pieces (e.g., the C.I. and E.I. ionizers 50 and 30, and impeller screens 44, 46) may be formed out of the usual chemically resistant, electroconductive structural materials such as stainless steel, e.g., 304, nickel, and the like.

The aperture 54 is in communication, through a suitable conduit 64, with a gas chromatograph, indicated generally as 70, to receive the effluent of the chromatograph (the effluent typically exits the chromatograph at a pressure of about 2 Torr). A selector switch 80 is provided so that either only a selected one of filaments 38 and 60, or both filaments simultaneously may be energized.

In operation, the gaseous effluents exiting gas chromatograph 70, including the charge exchange reactant gas, e.g., helium or hydrogen and the substance to be analyzed, are drawn through conduit 64 and mixed with the chemical ionization reactant gas, e.g., water which is fed through conduit 65 and into C.I. source 50. Because the reactant gas pressure in C.I. source 50 is relatively high, energization of filament 60 produces the reactant ions which in turn react with and chemically ionize the substrate entering the C.I. enclosure 52. The resultant ions exit through aperture 56 into the lower pressure vacuum envelope 18. To avoid fanning out and consequent dissipation of these ions as they enter the low pressure envelope region, the C.I. impeller screen 44, at −10 volts, is provided adjacent the aperture 56. This impeller screen, together with repeller plate 62, at +10 volts, impels the exiting positive ions on from the C.I. source 50, on their path to the mass spectrometer through the screen 44 and the screen 34 at the entrance of the E.I. source 30 and into the E.I. source. If E.I. filament 38 is also energized, the neutral gaseous substances entering E.I. source 30 will be subjected therein to electron-impact ionization. The impeller E.I. screen 46, at −10 volts, impels ions from the +6 volts E.I. source to and through the screen 24 in ground plate 20, into the filter region 12 of mass spectrometer 10. Again, E.I. impeller screen 46 tends to prevent dissipation of the ionized gases exiting the E.I. source and impels them into the analyzer system, to provide for maximum sensitivity.

The remaining mass spectral analysis proceeds conventionally in the mass spectrometer, with the resultant spectrum recorded, e.g., in the conventional manner with a recording oscillograph.

The selector switch 80 allows this system to be used in one of four distinct modes: Chemical ionization (by energizing C.I. filament 60 alone) so that the C.I. products are transmitted directly from the C.I. zone to the mass spectrometer; electron-impact ionization (by energizing E.I. filament 38 alone); super-imposed chemical and electron-impact ionization (by energizing both filaments 38, 60 simultaneously) and alternating chemical and electron-impact ionization (by alternatively energizing filaments 38 and 60). Thus, depending on the chosen mode of operation of the system, the following spectra of, e.g., the effluent of a gas chromatography column, are obtainable; C.I. mass spectra; E.I. mass spectra; simultaneous C.I. and E.I. mass spectra of a single sample both chemically and electron-impact ionized; and, separate C.I. and E.I. mass spectra at closely alternating short time intervals.

The advantages over the prior systems are apparent. First, one may obtain conventional C.I. and E.I. mass spectra from the very same ionization enclosure without the need for any special valving, splitters or separators, and without sacrificing sensitivity in either C.I. or E.I. mode, by the simple expedient of selectively energizing the appropriate filament. The dual capacity is achieved in a simple and hence reliable, and yet a versatile fashion.

When operating in a mode to obtain alternating C.I.-E.I. spectra, a mixture is separated, by gas chromatography, into components which emerge from the column at time intervals determined by the speed at which components traverse the gas chromatographic column. The components comprise the substance admixed with a reactant gas, e.g., helium, and are then mixed with a second reactant gas, e.g., water. The elapsed time during which a separated component appears in the gas chromatographic effluent in an analytically significant amount is short, e.g., about 15 seconds at half height. Thus, even if repeated switchover from chemical ionization to electron-impact ionization were possible with prior system without interrupting the flow characteristics of the effluent stream, it could not be accomplished effectively and repeatedly within this time interval. On the other hand, with the present system, alternating C.I. and E.I. spectra can be obtained at 3-second separation, well within the time interval during which a single component emerges in the effluent. Since variables relating to the flow rate, temperature, pressure, and the like of the emerging component will be substantially constant during the time required to record both spectra, the spectra are easy to correlate and analyze.

The system thus produces conventional C.I. and E.I. spectra, at conventionally used C.I. and E.I. pressures. For instance, a presently preferred pressure in the C.I. source 50 is at least $10^{-1}$ Torr and more preferably about 0.5 Torr; and a presently preferred pressure in the E.I. source 30 is at most about $4 \times 10^{-4}$ Torr. The sizes of envelope 18 and C.I. enclosure 52 as well as C.I. apertures 54, 56 and 58, and other variables such as flow rate through the gas chromatographic column or the capacity and pumping speed of pumping system 26, may be selected in accordance with well-known vacuum techniques to provide the appropriate pressures in the ionization sources. In general, a preferred size for aperture 56 is about 18 to 1800 mil$^2$. When it is desired to obtain only a C.I. spectrum, obviously the process of this invention can be conducted with the apparatus of FIG. 1 but without the E.I. zone 30 and screen 46 so that the products of this C.I. zone are directly transmitted to the mass spectometer. When employing this type of apparatus the size of the apertures remaining can be as disclosed above with reference to FIG. 1.

Although in the preferred embodiment, a quadrupole filter mass spectrometer is illustrated, it is comtemplated that applicant's two source (C.I. and E.I.) system is useful in providing ionized species for mass spectrometers using different analyzers for separating ions according to their mass-to-charge ratios.

The energy of the ionizing electrons are those customarily used for chemical and electron-impact ionization. 70 eV. is a presently standardized E.I. energy level (generally, 50 to 100 eV is a desired range). In general, about 100 to 500 eV is utilized for chemical ionization.

The precise value of the potential at the E.I. source 30 and the C.I. source 50 may be varied. When the system is operated in the simultaneous mode so that the ions formed in the chemical ionization zone will proceed through the energized E.I. source and on to the mass spectrometer, the value of these potentials is preferably, for positive ions, less positive in the C.I.-E.I. to mass spectrometer direction so as to cause ion flow into the mass spectrometer. The additional negative potential source at impeller screen 44 is particularly useful with a relatively open E.I. source as shown to minimize ion dissipation between the C.I. source and the mass spectrometer.

Figure 2:
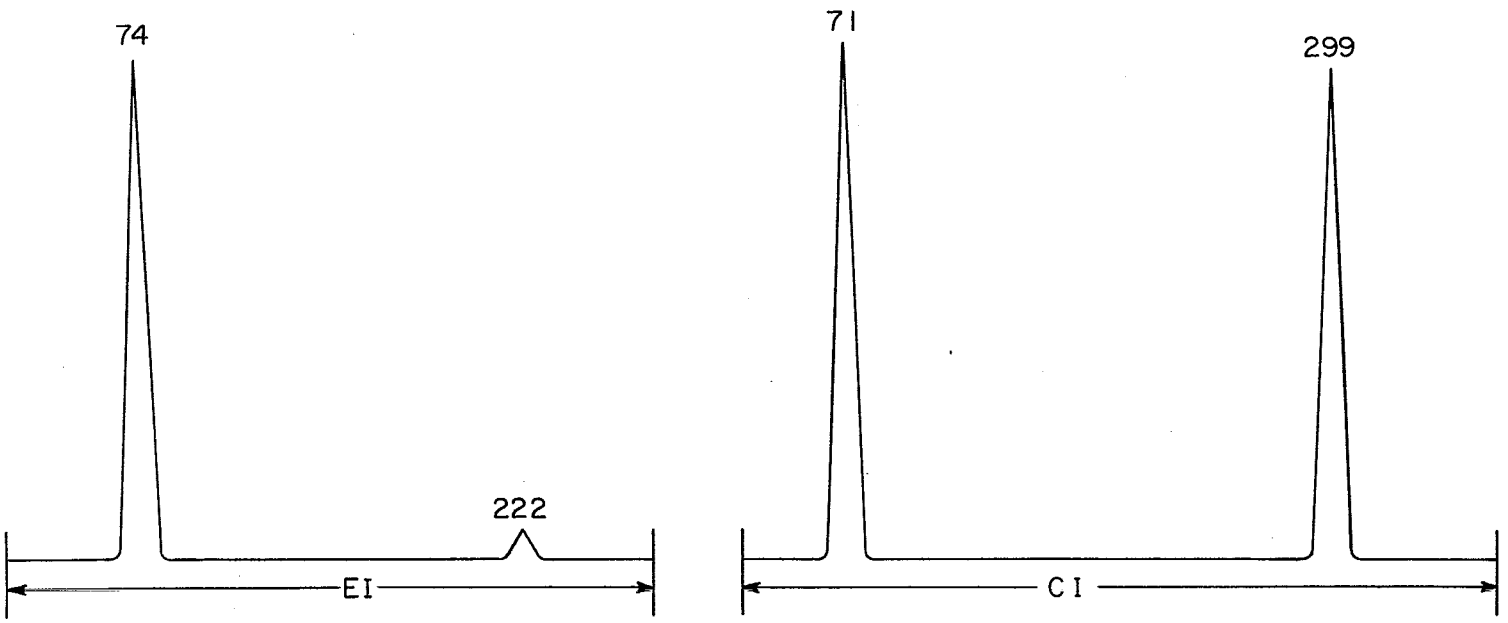
FIG. 2 is a diagramatical representation of alternating C.I. and E.I. spectra obtained by utilizing the present invention.
Figure 3:
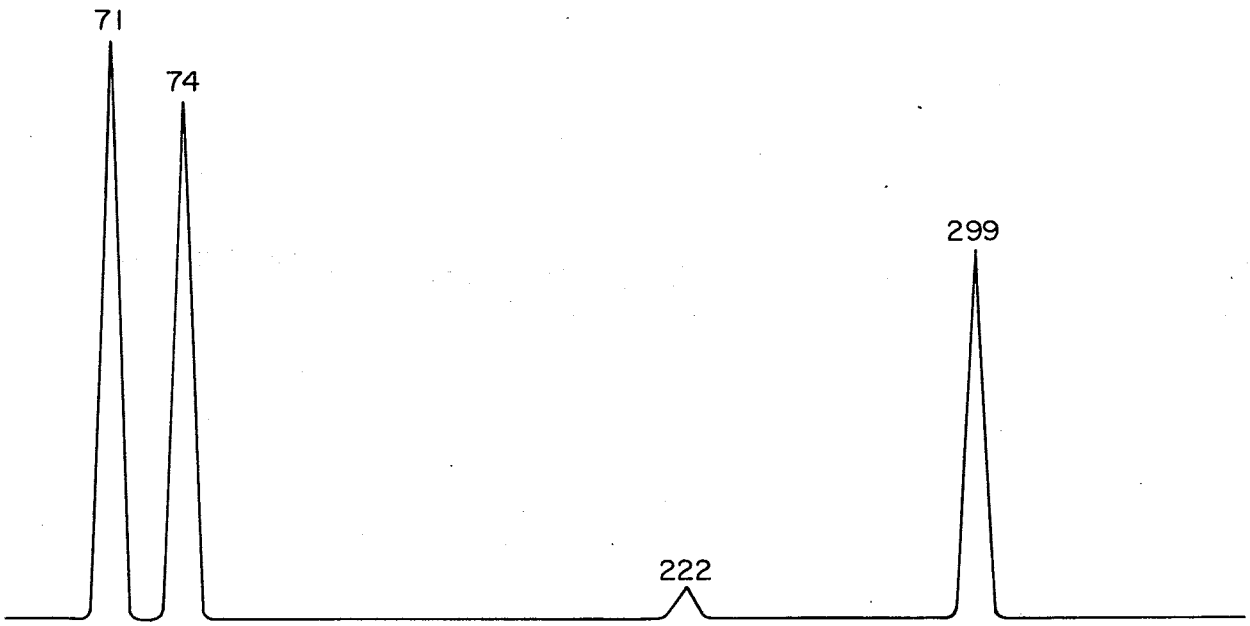
FIG. 3 is a diagramatical representation of a simultaneously C.I. — E.I. mass spectra obtained by utilizing the process of this invention.

FIGS. 2 and 3 illustrate the mass spectra obtainable utilizing this invention. The substance being analyzed was methyl 6,10,14-trimethylpentadecanoate. This substance was vaporized directly into the chemical ionization source 52 held at 200° C. and 0.5 Torr. The flow rate of the charge exchange reactant gas, helium, into the envelope 18 was less than 2 ml. per min. and the overall reactant gas composition (by volume) was 87% helium and 13% water.

Alternating E.I. and C.I. mass spectra, covering a m/e range of about 60 to 320, each of 3 seconds duration with a 3-second interval between them, are shown as diagrammatic representations of actual oscillographic recordings in FIG. 2. Additional alternating mass spectra may be obtained by continuing to switch back and forth.

FIG. 3 is a diagrammatic representation of an actual oscillographic recording of the simultaneous E.I.-C.I. mass spectrum of the same compound, methyl 6,10,14-trimethylpentadecanoate, scanned over the mass range of about 60 to 320 in 3 seconds. Both the E. I. and C.I. filaments were energized at the same time to provide this spectrum.

The abundant peak at m/e 299 in the C.I. mass spectrum (FIG. 2) is due to protonated methyl 6,10,14-trimethylpentadecanoate $(C_{19}H_{39}O_2)^+$ and is a clear indication of the molecular weight (298) of the sample; on the other hand, the molecular ion of the sample at m/e 298 in the E.I. mass spectrum (FIG. 2) is of such low abundance as to be left out of the Figure. However, abundant fragment peaks bearing primary structural information appear in the E.I. mass spectrum (FIG. 2) at, e.g., m/e 74 and 222 and are absent from the C.I. mass spectrum. Thus the two mass spectra are complementary. The simultaneous E.I.-C.I. mass spectrum (FIG. 3) combines the best features of each mass spectrum and shows the fragments (m/e 74, 222) bearing structural information as well as the peak (m/e 299) needed for molecular weight assignment.

I claim:

1. A method for analyzing a gaseous, vaporous or aerosol substance comprising the steps of chemically ionizing said substance in a chemical ionization zone at a chemical ionization pressure in the presence of a first gas comprising at least one selected from the group consisting of hydrogen and charge exchange reactant gases and a second gas comprising a chemical ionization reaction gas, said first and second gases being admixed with said substance in sufficient amount to effect chemical ionization of said substance, passing the first and second gases and the chemically ionized substance produced in said chemical ionization zone into an electron-impact ionization zone through an aperture sufficiently small to maintain a pressure drop between said zones, said electron-impact ionization zone being maintained at an electron-impact ionization pressure and obtaining the mass spectra of the ionized substances formed in said chemical ionization zone by passing the output of the electron-impact ionization zone to the input of a mass spectrometer.

2. The method of claim 1 wherein the product of said chemical ionization zone is subjected to electron-impact ionization in said electron-impact ionization zone; and obtaining the mass spectrum of the ionized substance formed in said chemical ionization zone and in said electron-impact ionization zone.

3. The method of claim 2 comprising alternatively obtaining a first mass spectra of ionized substances formed in said chemical ionization zone and a second mass spectra of ionized substances formed in said electron-impact ionization zone by alternately energizing said zones, wherein said first spectra and said second spectra are both obtained within a total elapsed time of about 30 seconds.

4. The method of claim 3 including the previous steps of separating said substance into components in a gas chromatograph and passing the effluent containing said components from said chromatograph to said chemical ionization zone, and wherein said two mass spectra are both obtained within the time width at half-height of a peak component of said effluent.

5. The method of claim 2 including the steps of energizing both of said ionization zones during passage therethrough of said gaseous substance so as to obtain a mass spectrum simultaneously indicative both of chemical ionization and of electron-impact ionization of said substance.

6. The method of claim 1 wherein said first gas is helium and said second gas is water vapor.

7. The method of claim 2 wherein said first gas is helium and said second gas is water vapor.

8. The method of claim 3 wherein said first gas is helium and said second gas is water vapor.

9. The method of claim 4 wherein said first gas is helium and said second gas is water vapor.

10. The method of claim 5 wherein said first gas is helium and said second gas is water vapor.

11. The method of claim 1 wherein said first gas is hydrogen and said second gas is water vapor.

12. The method of claim 2 wherein said first gas is hydrogen and said second gas is water vapor.

13. The method of claim 3 wherein said first gas is hydrogen and said second gas is water vapor.

14. The method of claim 4 wherein said first gas is hydrogen and said second gas is water vapor.

15. The method of claim 5 wherein said first gas is hydrogen and said second gas is water vapor.

16. A method for analyzing a gaseous, vaporous or aerosol substance comprising the steps of chemically ionizing said substance in a chemical ionization zone at a chemical ionization pressure in the presence of a first gas comprising at least one selected from the group consisting of hydrogen and charge exchange reactant gases and a second gas comprising a chemical ionization reactant gas, said first and second gases being admixed with said substance in sufficient amount to effect chemical ionization of said substance, and passing the product of said chemical ionization zone into a mass spectrometer through an aperture sufficiently small to maintain a pressure drop between said zone and said mass spectrometer to obtain a mass spectra of the ionized substances formed in said chemical ionization zone.

17. The method of claim 16 comprising in addition the step of separating said gaseous substance into components in a gas chromatograph before passing the effluent of said chromatograph containing said components and said charge exchange reactant gas from said chromatograph to said chemical ionization zone after adding said chemical ionization reactant gas to said effluent.

18. The method of claim 16 wherein said first gas is helium and said second gas is water vapor.

19. The method of claim 17 wherein said first gas is helium and said second gas is water vapor.

20. The method of claim 16 wherein said first gas is hydrogen and said second gas is water vapor.

21. The method of claim 17 wherein said first gas is hydrogen and said second gas is water vapor.

22. The method of claim 1 comprising in addition the step of separating said gaseous substance into components in a gas chromatograph before passing the effluent of said chromatograph containing said components and said charge exchange reactant gas from said chromatograph to said chemical ionization zone after adding said chemical ionization reactant gas to said effluent.

23. The method of claim 2 comprising in addition the step of separating said gaseous substance into components in a gas chromatograph before passing the effluent of said chromatograph containing said components and said charge exchange reactant gas from said chromatograph to said chemical ionization zone after adding said chemical ionization reactant gas to said effluent.

* * * * *

UNITED STATES PATENT AND TRADEMARK OFFICE

CERTIFICATE OF CORRECTION

PATENT NO. : 4,005,291

DATED : January 25, 1977

INVENTOR(S) : Guy P. Arsenault

It is certified that error appears in the above-identified patent and that said Letters Patent are hereby corrected as shown below:

In the ABSTRACT, line 5 change "reactants'" to --reactant--;

In Fig. 1 and the figure under the ABSTRACT, the screen 24 should be shown as a dashed line;

Column 1, line 10, after "1972," insert --now Patent No. 3,984,692,--;

Column 4, line 54, change "tetramethylsilione" to --tetramethylsilane--;

Column 9, line 45, insert a comma after "gases";

Column 10, line 47, insert a comma after "gases"

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*